US008285178B2

(12) United States Patent
Morimoto

(10) Patent No.: US 8,285,178 B2
(45) Date of Patent: Oct. 9, 2012

(54) IMAGE FORMING APPARATUS

(75) Inventor: Kiyofumi Morimoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 338 days.

(21) Appl. No.: 12/604,389

(22) Filed: Oct. 23, 2009

(65) Prior Publication Data

US 2010/0104305 A1 Apr. 29, 2010

(30) Foreign Application Priority Data

Oct. 29, 2008 (JP) ..... 2008-278229

(51) Int. Cl.
*G03G 15/08* (2006.01)

(52) U.S. Cl. ..... 399/256

(58) Field of Classification Search ..... 399/58, 399/61, 62, 256, 257, 29, 30, 119, 199, 224, 399/254, 260
See application file for complete search history.

(56) References Cited

U.S. PATENT DOCUMENTS 5,659,859 A * 8/1997 Kikuta et al. ..... 399/256
6,501,916 B2 * 12/2002 Suzuki ..... 399/30
2006/0008281 A1 * 1/2006 Matsumoto et al. ..... 399/27
2007/0127951 A1 * 6/2007 Ishikawa et al. ..... 399/254
2007/0274741 A1 11/2007 Shiraishi et al.
2008/0159789 A1 * 7/2008 Sugimoto et al. ..... 399/254

FOREIGN PATENT DOCUMENTS

JP 06-035318 2/1994
JP 10-063081 3/1998
JP 2007148182 A * 6/2007

* cited by examiner

*Primary Examiner* — Walter L Lindsay, Jr.
*Assistant Examiner* — Frederick Wenderoth
(74) *Attorney, Agent, or Firm* — Renner, Otto, Boisselle & Sklar, LLP

(57) ABSTRACT

A developing device conveys a two-component developer on a first route of circulation and a second route of circulation, and includes a guide plate and an electromagnet that are used for choosing, in accordance with toner densities detected by two toner density detecting sensors respectively provided in the two routes, whether toner supplied from a toner supply device is guided into the first or second route of circulation. This makes it possible to provide an image forming apparatus that, even in cases where a large amount of toner is consumed at one end of a developing roller along the axial direction in a developing device provided with one toner supply opening, can form an image free from nonuniformity in image density or photographic fogs that are caused by nonuniformity in toner density of a two-component developer.

8 Claims, 8 Drawing Sheets

IMAGE FORMING APPARATUS

This Nonprovisional application claims priority under 35 U.S.C. §119(a) on Patent Application No. 2008-278229 filed in Japan on Oct. 29, 2008, the entire contents of which are hereby incorporated by reference.

TECHNICAL FIELD

The present invention relates to an image forming apparatus that turns an electrostatic latent image into a visible image with use of an electrophotographic printing method.

BACKGROUND ART

There have conventionally been known electrophotographic image forming apparatuses such as copying machines, printers, and facsimiles. An electrophotographic image forming apparatus forms an electrostatic latent image on a surface of a photoreceptor drum (toner image bearing member), develops the electrostatic latent image by supplying the photoreceptor drum with toner through a developing device, transfer, onto a sheet such as a sheet of paper, a toner image formed on the photoreceptor as a result of the development, and fixes the toner image onto the sheet through a fixing device.

In recent years, a two-component developer excellent in charging stability of toner has been commonly used in full-color and/or high-definition image forming apparatuses.

The two-component developer is composed of toner and carrier. The toner and the carrier are agitated in a developing device, whereby friction between the toner and the carrier is caused, and the friction allows the toner to be appropriately charged.

In the developing device, the charged toner is supplied, for example, onto a surface of a developing roller, and moved by an electrostatic force of attraction to an electrostatic latent image formed on a photoreceptor drum. This allows a toner image based on electrostatic latent image to be formed on the photoreceptor drum.

Furthermore, recently, image forming apparatuses have been required to be higher in speed and smaller in size. This raises the need to charge a two-component developer quickly and sufficiently and also convey it quickly.

In order to disperse supplied toner into a two-component developer immediately and impart an appropriate amount of charge to the toner, an image forming apparatus employs a circulating developing device. The circulating developing device includes: a two-component developer conveying path serving as a route on which the two-component developer is circularly conveyed; and a two-component developer conveying member that conveys the two-component developer while agitating it in the two-component developer conveying path.

For example, Patent Literature 1 describes a developing device which does not apply undue force on a developer, which can disperse supplied toner into the developer immediately and impart an appropriate amount of charge to the toner, and which is highly capable of equalize the toner density of the developer in a developer storage section. That is, the developer storage section, in which a two-component developer obtained by mixing toner and carrier together is stored, is provided with a developer conveying path serving as a route on which the developer is circularly transported, and the developer conveying path has a developer conveying member provided therein, the developer conveying member having wing bars in the form of feed screws with a meshed screen member attached between the wing bars. The developer conveying member rotates to convey the developer. The developer is agitated by passing through the meshed screen member more than once. Friction between the toner and the carrier allows appropriate charging.

CITATION LIST

Patent Literature 1

Japanese Patent Application Publication, Tokukaihei, No. 10-63081 A (Publication Date: Mar. 6, 1998)

SUMMARY OF INVENTION

Technical Problem

However, while such a circulating developing device as mentioned above has the merit of being able to be reduced in size, it has such a problem that continuous printing of a large number of images that consume a large amount of toner at one end of a developing roller along the axial direction (in part of the front side or rear side) causes nonuniformity in toner density of a two-component developer and the nonuniformity in toner density causes nonuniformity in image density and photographic fogs. Such a problem may be solved by a method including providing the developing device with toner supply openings located near both ends of the developing roller along the axial direction, respectively, and supplying toner to that one of the toner supply openings through which a large amount of toner has been consumed. However, there is such a problem that an increase in number of toner supply openings makes a reduction in size difficult.

The present invention has been made in view of the foregoing problems, and it is an object of the present invention to provide an image forming apparatus which, even in cases where a large amount of toner is consumed at one end of a developing roller along the axial direction in a developing device provided with one toner supply opening, is free from nonuniformity in image density or photographic fogs that are caused by nonuniformity in toner density of a two-component developer.

Solution to Problem

An image forming apparatus according to the present invention is an image forming apparatus including an image bearing member, a developing device that supplies the image bearing member with toner contained in a two-component developer, and a toner supply device that supplies the developing device with toner, the developing device including: a developing roller; a developing container in which the two-component developer is stored, the developing container having a partition member that is used for dividing an internal space of the developing container into a first compartment and a second compartment and that extends along an axial direction of the developing roller; and a conveying member, installed in the first and second compartments, which agitates and conveys the two-component developer, the developing roller supplying the image bearing member with toner contained in a two-component developer stored in the second compartment, the first and second compartments being communicated with each other through a first communicating path at one end of the axial direction and through a second communicating path at the other end of the axial direction, the partition member having a third communicating path, provided between the first and second communicating path, through which the first and second compartments are communicated with each other, the developing container including an upper wall covering the first compartment, a first toner density detecting sensor provided between the first communicating path and the third communicating path in the second compartment, and a second toner density detecting sensor provided between the second communicating path and the third communicating path in the second compartment, the upper wall having one toner supply opening, provided in a higher position than a portion of the first compartment that faces the third communicating path, which is used for receiving the toner that is supplied from the toner supply device, the conveying member conveying the two-component developer on (i) a first route of circulation leading from the third communicating path to the first communicating path in the first compartment and further leading from the first communicating path to the third communicating path in the second compartment and (ii) a second route of circulation leading from the third communicating path to the second communicating path in the first compartment and further leading from the second communicating path to the third communicating path in the second compartment, the image forming apparatus including a toner supply switching section that chooses, in accordance with toner densities detected by the first and second toner density detecting sensors, whether the toner that is supplied from the toner supply device is guided into the first or second route of circulation.

Advantageous Effects of Invention

Even in cases where a large amount of toner is consumed at one end of a developing roller along the axial direction in a developing device provided with one toner supply opening, an image forming apparatus according to the present invention can form an image free from nonuniformity in image density or photographic fogs that are caused by nonuniformity in toner density of a two-component developer.

For a fuller understanding of the nature and advantages of the invention, reference should be made to the ensuing detailed description taken in conjunction with the accompanying drawings.

DESCRIPTION OF EMBODIMENTS

A preferred embodiment of the present invention is fully described below with reference to the attached drawings.

(Overall Configuration of an Image Forming Apparatus)

First, an image forming apparatus according to the present invention is described.

Figure 8:
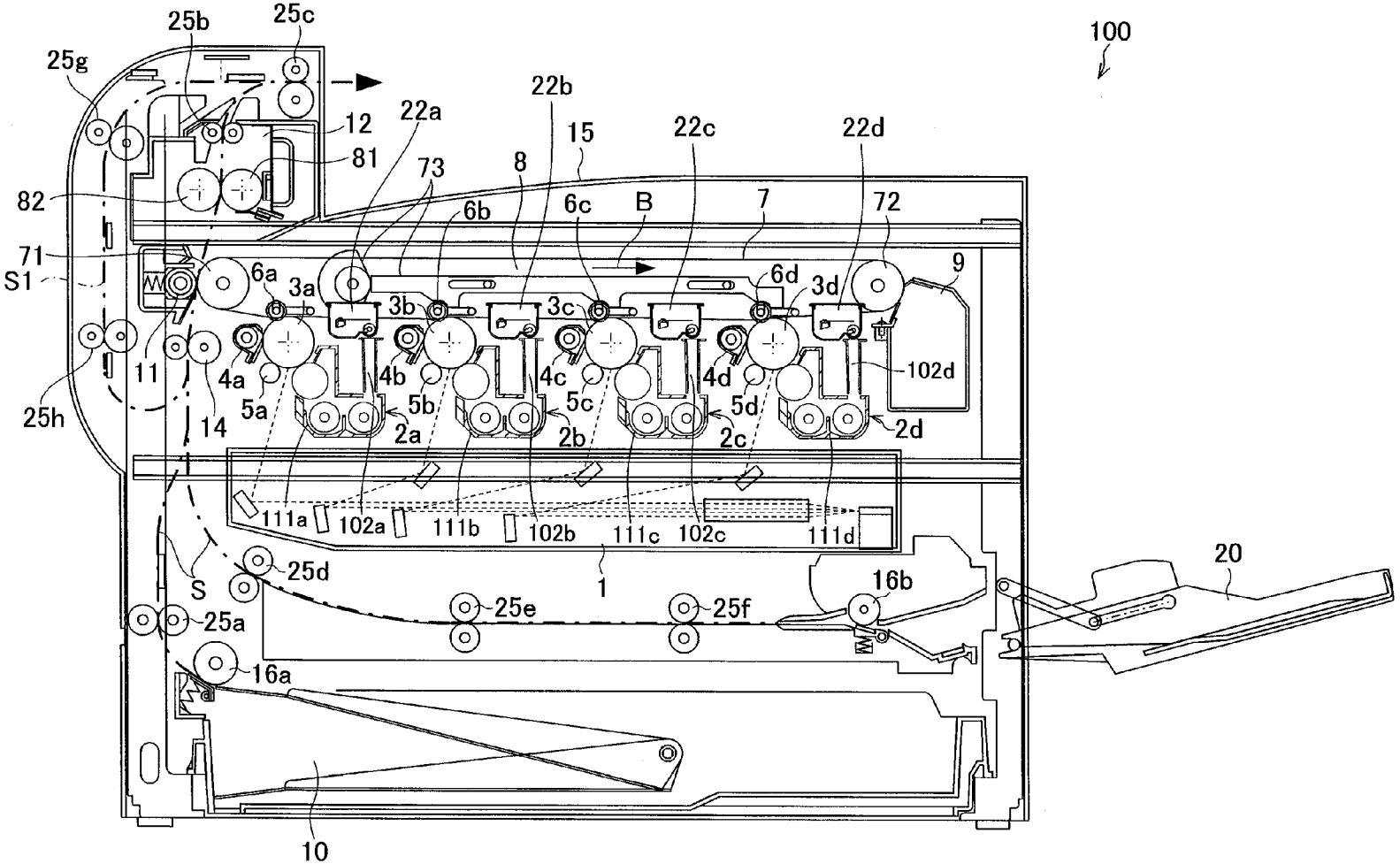
FIG. 8 is a cross-sectional view of an image forming apparatus according to the present embodiment of the present invention.

FIG. 8 is an explanatory diagram showing the overall configuration of an embodiment of an image forming apparatus 100 according to the present invention.

The image forming apparatus 100 forms a multicolor or single-color image as a visible image on a predetermined sheet (sheet of recording paper) in accordance with image data contained in an input command, such as image data sent from an outside source through a communication network or the like. As shown in FIG. 8, the image forming apparatus 100 of the present embodiment includes: photoreceptor drums 3*a* to 3*d*, which correspond to image bearing members on surfaces of which latent images are formed; charging devices (charging rollers) 5*a* to 5*d*, which charge the surfaces of the photoreceptor drums 3*a* to 3*d*, respectively; an exposure unit (exposure device) 1, which forms electrostatic latent images on the surfaces of the photoreceptor drums 3*a* to 3*d*; developing devices 2*a* to 2*d*, which form toner images by supplying toner to the surfaces of the photoreceptor drums 3*a* to 3*d*, respectively; toner supply devices 22*a* to 22*d*, which supply toner to the developing devices 2*a* to 2*d*, respectively; an intermediate transfer belt unit (transfer device) 8, which transfers the toner images from the surfaces of the photoreceptor drums 3*a* to 3*d* to a recording medium; a fixing unit (fixing device) 12, which fixes the toner images onto the recording medium; cleaner units 4*a* to 4*d*, which remove and collect toner; paper carrying paths S and S1; a paper feeding cassette 10; a manual paper feeding tray 20; and a paper output tray 15. It should be noted that a scanner may be provided above the image forming apparatus 100.

The image forming apparatus 100 of the present embodiment forms a visible color image by processing image data corresponding to four colors, namely black (K), cyan (C), magenta (M), and yellow (Y). Therefore, the number of developing devices 2*a* to 2*d* provided, the number of photoreceptor drums 3*a* to 3*d* provided, the number of charging rollers 5*a* to 5*d* provided, and the number of cleaner units 4*a* to 4*d* provided are each four so that four types of latent image corresponding to their respective colors are formed. In other words, there are provided four image forming stations (image forming sections) each including a developing device, a photoreceptor drum, a charger, and a cleaner unit. The four image forming stations are arranged in the order of four colors along the direction of movement of an intermediate transfer belt 7 (see the arrow B in FIG. 8). It should be noted that the signs a to d correspond to black, cyan, magenta, and yellow, respectively.

The photoreceptor drums 3*a* to 3*d*, which are substantially cylindrical image bearing members, are controlled by control means (not shown) in such way as to be rotated in a predetermined direction by driving means (not shown). The photoreceptor drums 3*a* to 3*d* are each constituted by a substrate and a photoconducting layer formed thereon. For example, a photoconducting layer made of amorphous silicon (a-Si), selenium (Se), an organic photoconductor (OPC), or the like is formed into a thin film on the outer surface of a metal drum, made of aluminum or the like, which serves as a substrate. It should be noted that the constitution of each of the photoreceptor drums 3*a* to 3*d* is not particularly limited to that mentioned above.

The charging rollers 5*a* to 5*d* are contact-type chargers that uniformly charge the surfaces of the photoreceptor drums 3*a* to 3*d* at predetermined potentials, respectively. In the present embodiment, as shown in FIG. 8, the charging devices are realized by contact-type roller chargers; however, the charging rollers 5*a* to 5*d* may be replaced by contact-type brush chargers, or noncontact-type chargers.

The exposure unit 1, disposed below the photoreceptor drums 3*a* to 3*d*, is a laser-scanning unit (LSU) including a laser irradiation section and a reflection mirror. Alternatively, the exposure unit 1 may be an EL (electroluminescence) or LED writing head including an array of light-emitting elements. The exposure unit 1 exposes the charged photoreceptor drums 3*a* to 3*d* in accordance with the input image data, whereby electrostatic latent images based on the image data are formed on the surfaces of the photoreceptor drums 3*a* to 3*d*, respectively.

The developing devices 2*a* to 2*d* visualize (develop), with toner, the electrostatic latent images formed on the photoreceptor drums 3*a* to 3*d*, respectively. The developing devices 2*a* to 2*d* contains their respective colors of toner, namely black toner, cyan toner, magenta toner, and yellow toner. The developing devices 2*a* to 2*d* visualize, into black, cyan, magenta, and yellow toner images, the black, cyan, magenta, and yellow electrostatic latent images formed on the photoreceptor drums 3*a* to 3*d*, respectively. Disposed above the developing devices 2*a* to 2*d* are toner transport mechanisms 102*a* to 102*d* and toner supply devices 22*a* to 22*d*, respectively.

The toner supply devices 22*a* to 22*d*, disposed above the developing devices 2*a* to 2*d*, are used for storing unused toner (powdered toner), (the details of which are described later).

The intermediate transfer belt unit 8, disposed above the photoreceptor drums 3*a* to 3*d*, includes intermediate transfer rollers 6*a* to 6*d*, the intermediate transfer belt 7, an intermediate transfer belt driving roller 71, an intermediate transfer belt driven roller 72, an intermediate transfer belt tension mechanism 73, an intermediate transfer belt cleaning unit 9, and a transfer roller 11. The intermediate transfer rollers 6, the intermediate transfer belt driving roller 71, the intermediate transfer belt driven roller 72, and the intermediate transfer belt tension mechanism 73 serve to provide the intermediate transfer belt 7 in a tensioned state, and also to drive the intermediate transfer belt 7 to rotate in the direction of the arrow B.

The intermediate transfer rollers 6 are rotatably supported in intermediate transfer roller installation parts of the intermediate transfer belt tension mechanism 73 of the intermediate transfer belt unit 8, respectively. The intermediate transfer rollers 6 are given transfer biases whose polarity is opposite to the charging polarity of the toner, so that the toner images carried on the surfaces of the photoreceptor drums 3*a* to 3*d* are transferred onto the intermediate transfer belt 7. According to this, the black, cyan, magenta, and yellow toner images respectively formed on the photoreceptor drums 3*a* to 3*d* are transferred onto the outer surface of the intermediate transfer belt 7 in such a way as to be sequentially superimposed onto one another, with the result that a full-color toner image is formed on the outer surface of the intermediate transfer belt 7.

Each of the intermediate transfer rollers 6 has, as its base, a metal (e.g., stainless-steel) shaft having a diameter of 8 mm to 10 mm. Each of the intermediate transfer rollers 6 has a surface covered with an electrically-conductive elastic material (e.g., EPDM and urethane foam). Such an electrically-conductive elastic material enables the intermediate transfer rollers 6 to apply high voltages uniformly to the intermediate transfer belt 7. The intermediate transfer rollers 6 are realized by roller-type transfer electrodes (intermediate transfer rollers 6) in the present embodiment, but may be realized by brush-type transfer electrodes instead.

The intermediate transfer belt 7 is provided in such a way as to make contact with each of the photoreceptor drums 3*a* and 3*d*. Onto the intermediate transfer belt 7, the black, cyan, magenta, and yellow toner images respectively formed on the photoreceptor drums 3*a* to 3*d* are transferred in such a way as to be sequentially superimposed onto one another, whereby a color toner image (multicolor toner image) is formed. The intermediate transfer belt 7 is made of a film with a thickness, for example, of approximately 100 μm to 150 μm in such a way as to have no ends.

The transfer of the toner images from the photoreceptor drums 3*a* to 3*d* onto the intermediate transfer belt 7 is carried out by the intermediate transfer rollers 6 making contact with the reverse side of the intermediate transfer belt 7. The intermediate transfer rollers 6 are given high-voltage transfer biases (high voltages whose polarity (+) is opposite to the charging polarity (−) of the toner) so that the toner images are transferred.

As mentioned above, the black, cyan, magenta, and yellow electrostatic latent images on the photoreceptor drums 3*a* to 3*d* are visualized with the black toner, the cyan toner, the magenta, and the yellow toner into toner images, respectively. These toner images are superimposed onto one another on the intermediate transfer belt 7. The toner images thus superimposed are moved by the rotation of the intermediate transfer belt 7 to a position of contact (transfer section) between the intermediate transfer belt 7 and a sheet of paper carried thereto, and then transferred onto the sheet of paper by the transfer roller 11 disposed in this position. In this case, the intermediate transfer belt 7 and the transfer roller 11 are pressed against each other so that a predetermined nip is formed therebetween, and the transfer roller 11 is given a voltage (high voltage whose polarity (+) is reverse to the charging polarity (−) of the toner) so that the toner images are transferred onto the sheet of paper.

For the purpose of obtaining the nip constantly, one of the transfer roller 11 and the intermediate transfer belt driving roller 71 is made of a hard material such as metal, and the other is made of a soft material (e.g., elastic rubber or resin foam).

Toner adhering to the intermediate transfer belt 7 as the result of the contact of the intermediate transfer belt 7 with the photoreceptor drums 3 and toner remaining on the intermediate transfer belt 7 without being transferred when the toner images were transferred from the intermediate transfer belt 7 onto the sheet of paper are removed and collected by the intermediate transfer belt cleaning unit 9 lest such toner causes a mixture of the colors of toner in the next step.

The cleaner units 4 collect and remove, with a lubricant or the like, toner remaining on the surfaces of the photoreceptor drums 3*a* to 3*d* after the development and image transfer steps, respectively.

The intermediate transfer belt cleaning unit 9 includes a cleaning blade (cleaning member) that makes contact with the intermediate transfer belt 7. That part of the intermediate transfer belt 7 which makes contact with the cleaning blade is supported by the intermediate transfer belt driven roller 72 in such a way that the reverse side of that part makes contact with the intermediate transfer belt driven roller 72.

The paper feeding cassette 10 is used for storing sheets (e.g., sheets of recording paper) for use in image formation, and is provided below the image forming section and the exposure unit 1. Meanwhile, the paper output tray 15, provided on top of the image forming apparatus 100, is used for outputting a printed sheet in such a manner that the print side faces downward.

When a sheet of paper fed from the paper feeding cassette 10 or the manual paper feeding tray 20 passes through the space between the transfer roller 11 and the intermediate transfer belt 7, the transfer roller 11 is given a high voltage whose polarity (+) is opposite to the charging polarity (−) of the toner. Thus, the black, cyan, magenta, and yellow electrostatic latent images on the photoreceptor drums 3*a* to 3*d* are visualized with the black toner, the cyan toner, the magenta, and the yellow toner into toner images, respectively, and these toner images are superimposed onto one another on the intermediate transfer belt 7. After that, the superimposed toner images are moved by the rotation of the intermediate transfer belt 7 to a position of contact between the intermediate transfer belt 7 and the sheet of paper carried thereto, and then transferred from the outer surface of the intermediate transfer belt 7 onto the sheet of paper by the transfer roller 11 disposed in this position.

Further, the image forming apparatus 100 is provided with the paper carrying path S along which a sheet of paper is guided from the paper feeding cassette 10 or the manual paper feeding tray 20 onto the paper output tray 15 via the transfer section and the fixing unit 12. It should be noted that the transfer section is located between the intermediate transfer belt driving roller 71 and the transfer roller 11.

Disposed on the paper carrying path S are pickup rollers 16*a* and 16*b*, a registration roller 14, the transfer section, the fixing unit 12, carrying rollers 25*a* to 25*h*, and the like.

The pickup roller 16*a* is a feeding roller provided at one end of the paper feeding cassette 10 so as to supply each separate sheet of paper to the paper carrying path S from the paper feeding cassette 10. The pickup roller 16-2 is a feeding roller provided near the manual paper feeding tray 20 so as to feed each separate sheet of paper to the paper carrying path S from the manual paper feeding tray 20. Each of the carrying rollers 25 is a small-sized roller for facilitating/assisting the carriage of a sheet of paper. The transportation rollers 25 are provided along the paper carrying path S.

The fixing unit 12 includes a heat roller 81 and a pressure roller 82. The heat roller 81 and the pressure roller 82 rotate with a sheet sandwiched therebetween. The heat roller 81 is controlled by a control section (not shown) so as to have a predetermined fixing temperature. The control section controls the temperature of the heat roller 81 in accordance with a detection signal sent from a temperature detector (not shown).

The sheet between the heat roller 81 and the pressure roller 82 is subjected to heat and pressure. This causes melting and mixing of the black, cyan, magenta, and yellow toner images, which have been transferred onto the sheet, with the result that the toner images are pressed and fixed by heat on the sheet. The sheet having the multicolor toner image (black, cyan, magenta, and yellow toner images) fixed thereon is carried by the plurality of carrying rollers 25 to a reverse paper output path of the paper sheet carrying path S, and then is outputted onto the paper sheet output tray 15 in a reversed manner (i.e., in such a manner that the multicolor toner image faces downward).

The registration roller 14 temporarily holds a sheet fed from the paper feeding cassette 10 or the manual paper feeding tray 20, which is used in cases where a small number of sheets are printed, and being carried along the sheet carrying path S1, or at a timing synchronized with the rotation of the intermediate transfer belt 7, guides, into the space between the transfer roller 11 and the intermediate transfer belt 7, a sheet of paper carried via the paper carrying path S. For this purpose, the registration roller 14 stops its rotation at the start of operation of the photoreceptor drums and the intermediate transfer belt 7, and a sheet of paper fed or carried prior to the rotation of the intermediate transfer belt 7 stops its movement along the paper carrying path S, with its front edge in contact with the registration roller 14. After this, the registration roller 14 starts its rotation at such a timing that the front-edge portion of the sheet of paper and the front-edge portion of the toner images formed on the intermediate transfer belt 7 face each other in the position where the transfer roller 11 and the intermediate transfer roller 7 are pressed against each other.

It should be noted here that in the case of singe-side printing, the sheet carrying path S serves as a route along which a sheet of paper from the paper feeding cassette 10 or the manual paper feeding tray 20 is carried to the paper output tray 15, and that in the case of duplex printing, the sheet carrying path S1 serves as a route along which a sheet of paper finished with single-side printing is carried so that the reverse side is printed.

Specifically, in the case of single-side printing, a sheet carried from the paper feeding cassette 10 is carried to the registration roller 14 by the carrying roller 25*a* in the sheet carrying path S, and then carried to the transfer section (position of contact between the transfer roller 11 and the intermediate transfer belt 7) by the registration roller 14 at such a timing that the head of the sheet and the head of the toner images superimposed on the intermediate transfer belt 7 coincide with each other. In the transfer section, the toner images are transferred onto the sheet, and the toner images are fixed onto the sheet by the fixing unit 12. After that, the sheet is outputted from the carrying roller 25*b* onto the paper output tray 15 through the paper output roller 25*c*.

Alternatively, a sheet carried from the manual paper feeding tray 20 is carried to the registration roller 14 by the plurality of carrying rollers 25 (25*f*, 25*e*, 25*d*). In the subsequent sheet carrying operation, the sheet is outputted onto the paper output tray 15 along the same path as a sheet supplied from the aforementioned paper feeding cassette 10.

Meanwhile, in the case of duplex printing, the rear edge of a sheet finished with single-side printing and having passed through the fixing unit 12 is held by the paper output roller 25*c*. Next, the sheet is guided toward the carrying rollers 25*g* and 25*h* by reverse rotation of the paper output roller 25*c*, passed through the registration roller 14, and then outputted onto the paper output tray 15 after the reverse side has been printed.

(Structure of the Toner Supply Devices)

The structure of the toner supply devices 22*a* to 22*d* (hereinafter represented simply as 22) according to the embodiment of the present invention is described below with reference to FIGS. 6 through 8.

The toner supply devices 22, disposed above the developing devices 2*a* to 2*d* (see FIG. 8; hereinafter represented simply as 2), are used for storing unused toner (powdered toner).

Figure 6:
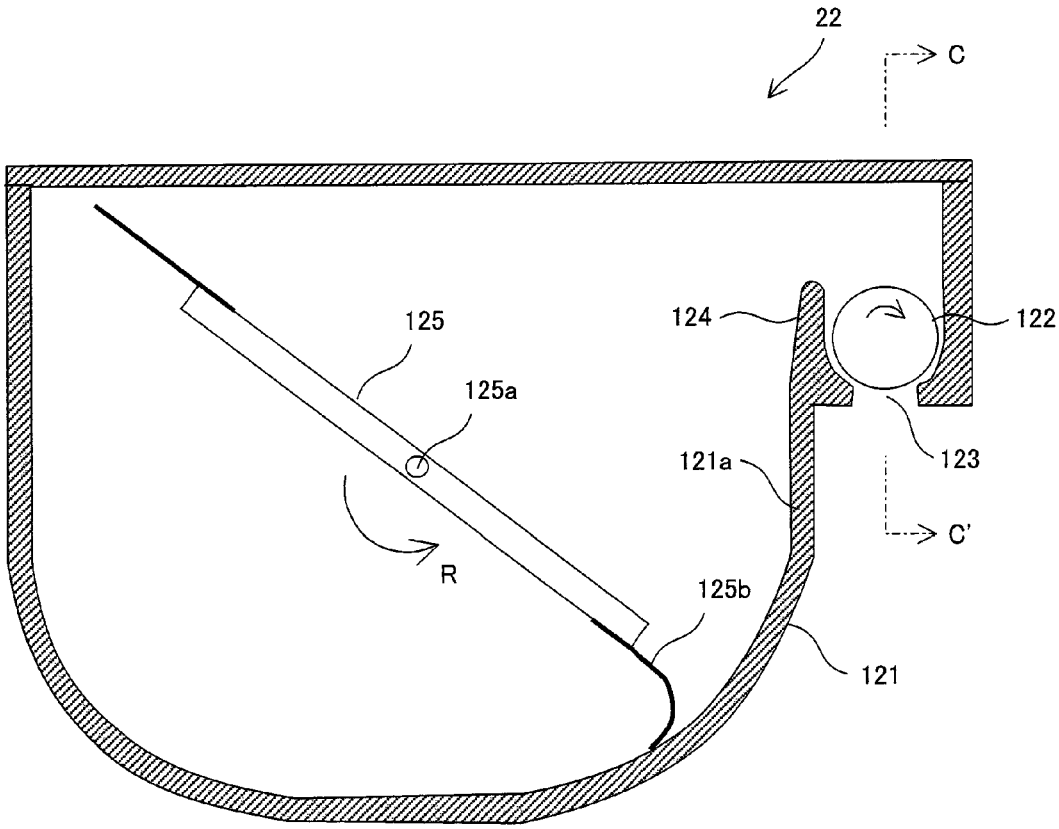
FIG. 6 is a cross-sectional view showing the configuration of a main part of a toner supply device according to the embodiment of the present invention.

FIG. 6 is a cross-sectional view showing the configuration of each of the toner supply devices 22 shown in FIG. 8. As shown in FIG. 6, the toner supply device 22 includes a toner storage container 121, a toner discharge member 122 disposed in the toner storage container 121, and a toner agitating member 125 disposed in the toner storage container 121.

The toner storage container 121 is a hollow and substantially semicylindrical container member in which toner is stored, and the toner discharge member 122 and the toner agitating member 125, both disposed in the toner storage container 121, are rotatably supported by the toner storage container 121. The toner storage container 121 has a toner discharge opening 123 provided below the toner discharge member 122, and has a toner discharge member partition wall 124 provided between the inside of the toner storage container 121 in which the toner agitating member 125 is disposed and the toner discharge member 122.

The toner discharge member partition wall 124 is such that an appropriate amount of toner scooped up by the toner agitating member 125 can be held in the area surrounding the toner discharge member 122.

The toner discharge opening 123, which is a substantially rectangular opening provided toward the central part along the axial direction, is disposed in a higher position than the corresponding one of the toner transport mechanisms 102*a* to 102*d* (see FIG. 8; hereinafter represented simply as 102).

Figure 7:
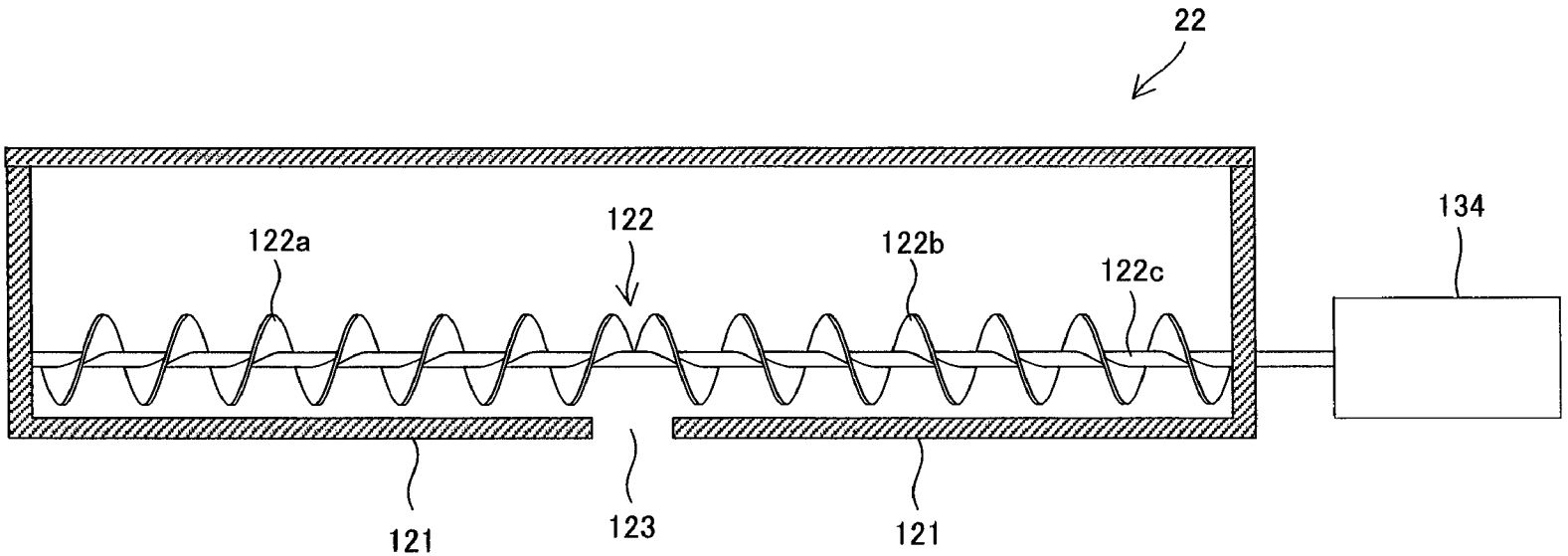
FIG. 7 is a cross-sectional view taken along arrows C-C' in FIG. 6.

FIG. 7 is a cross-sectional view, taken along arrows C-C' in FIG. 6, in which the area surrounding the toner discharge member 122 is enlarged. As shown in FIG. 7, the toner discharge member 122 is rotated so that the toner stored in the toner storage container 121 is supplied from the toner discharge opening 123 to the developing device 2 through the toner transport mechanism 102. As shown in FIG. 7, the toner discharge member 122 is constituted by a screw auger including a first toner conveying blade 122*a*, a second toner conveying blade 122*b*, and a toner discharge member rotating shaft 122*c* that rotates integrally with the first and second toner conveying blades 122*a* and 122*b*. The toner discharge member rotating shaft 122*c* is driven by a toner discharge member driving motor 134 to rotate. It should be noted here that the first and second toner conveying blades 122*a* and 122*b* have their blades wound in opposite directions, and the rotation of the toner discharge member rotating shaft 122*c* is controlled by the toner discharge member driving motor 134 so that the toner can be conveyed toward the toner discharge opening 123 from each end of the toner discharge member 122 along the axial direction.

The toner discharge member 122, which is a screw auger, is large in amount of toner that is discharged per unit time, for example, in comparison with a sponge roller. Therefore, a large amount of toner can be discharged in a short period of time.

The toner agitating member 125 is a plate member that rotates on a toner agitating member rotation axis 125*a* and thereby scoops up the toner stored in the toner storage container 121 and conveys the toner to the toner discharge member 122, while agitating the toner stored in the toner storage container 121. The toner agitating member 125 has a toner scooping member 125*b* at each end. The toner scooping members 125*b*, made of a flexible polyethylene terephthalate (PET) sheet, are attached to both ends of the toner agitating member 125.

In FIG. 6, the rotation of the toner agitating member 125 in the direction of an arrow R allows the toner to be agitated and scooped up toward the toner discharge member 122. At this point, each of the toner scooping members 125*b* rotates while deforming, owing to the flexibility, to slide over an inner wall 121*a* of the toner storage container 121, thereby supplying the toner to the toner discharge member 122. Then, the toner discharge member 122 guides the supplied toner into the toner discharge opening 123 by rotating.

(Structure of the Developing Devices)

The structure of the toner supply devices 2 according to the embodiment of the present invention is described below with reference to FIGS. 2, 3, and 8.

Figure 2:
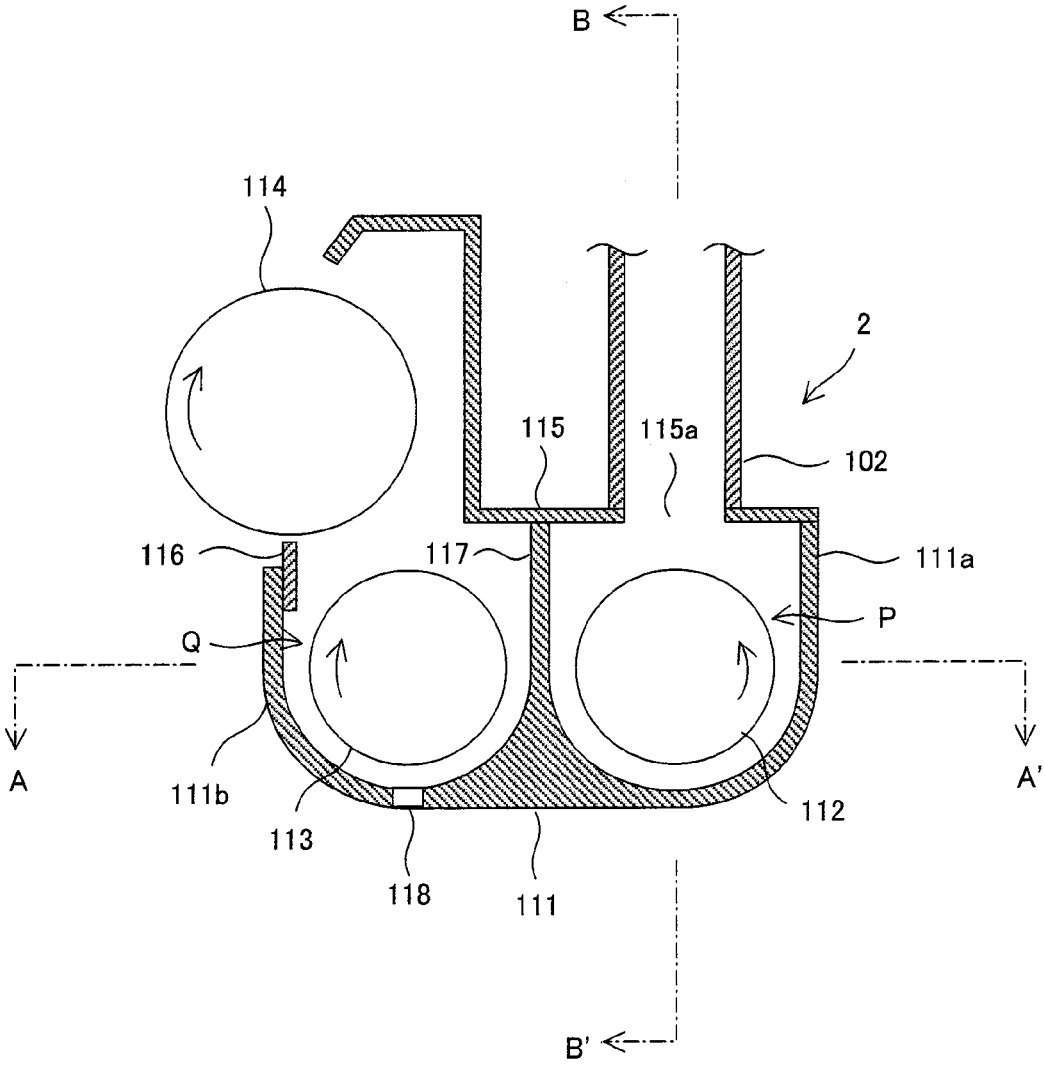
FIG. 2 is a cross-sectional view showing the configuration of a main part of the developing device according to the embodiment of the present invention.
Figure 3:
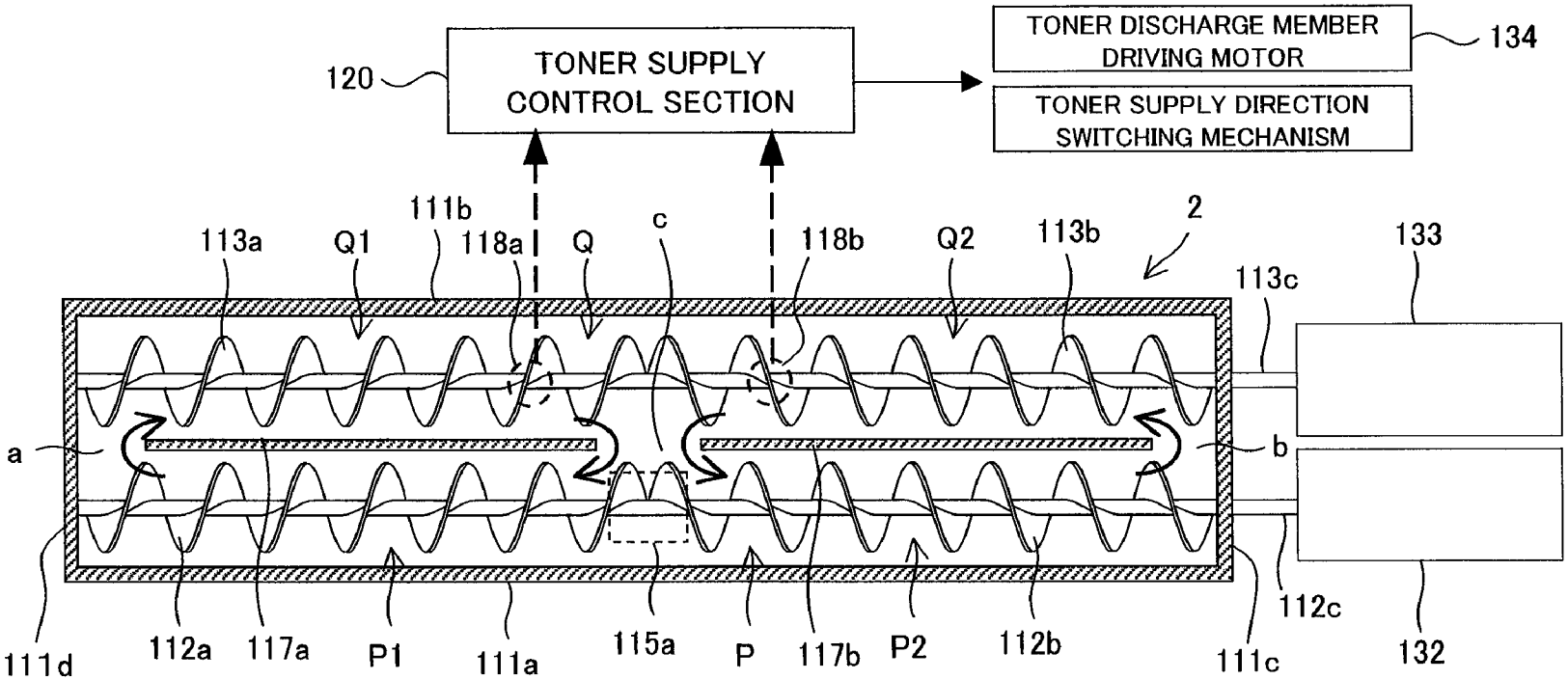
FIG. 3 is a cross-sectional view taken along arrows A-A' in FIG. 2.

FIG. 2 is a cross-sectional view showing the configuration of each of the developing devices 2, and FIG. 3 is a cross-sectional view taken along arrows A-A' in FIG. 2.

As shown in FIG. 2, the developing device 2 includes a developing tank (developing container) 111 (see 111*a* to 111*d* in FIG. 8), first and second conveying members 112 and 113 put inside of the developing tank 111, a developing roller 114, a developing tank cover (developing container) 115 provided with a toner supply opening 115*a*, a doctor blade 116, a partition plate (partition member) 117 (see 117*a* and 117*b* in FIG. 3), toner density detecting sensors 118 (see 118*a* and 118*b* in FIG. 3), and a toner supply control section (toner supply switching section) 120.

The developing tank 111 is a tank in which a two-component developer containing toner received from the toner supply device 22 and carrier (such as magnetic carrier) is stored, and the first and second conveying members 112 and 113, both disposed in the developing tank 111, are rotatably supported by the developing tank 111. The developing tank 111 is used for circularly conveying the two-component developer inside thereof. As shown in FIG. 2, the developing tank 111 is divided by the partition plate 117, which is parallel to the axial direction of the developing roller 114, into two compartments P and Q in which the two-component developer is stored. Moreover, the compartment (first compartment) P has the first conveying member 112 installed therein, and the compartment (second compartment) Q has the second conveying member 113 installed therein.

The developing tank cover 115 is a cover that is put on top of the developing tank 111, and has the toner supply opening 115*a*, provided in a position corresponding to an upper surface of the substantially central part of the compartment P having the first conveying member 112 installed therein, through which the toner is received. It should be noted that the developing tank cover 115 functions as an upper wall of the developing container.

As shown in FIG. 3, the first and second conveying members 112 and 113 are members for circularly conveying the toner, which has been received through the toner supply opening 115*a*, in the developing tank 111.

The first conveying member 112 is constituted by a screw auger including a first conveying blade 112*a* formed in such a spiral manner as to extend from the central part of the first conveying member 112 to one end of the first conveying member 112, a second conveying blade 112*b* formed in such a way as to extend from the central part of the first conveying member 112 to the other end of the first conveying member 112, and a first rotating shaft 112*c* that rotates integrally with the first and second conveying blades 112*a* and 112*b*. It should be noted that the first rotating shaft 112*c* is parallel to the axial direction of the developing roller 114. Since the first and second conveying blades 112*a* and 112*b* have their blades wound in opposite directions, the rotation of the first rotating shaft 112*c* is controlled by a first conveying member driving motor 132, connected to one end of the first rotating shaft 112*c*, so that the two-component developer can be conveyed from the central part of the first rotating shaft 112*c* toward each end of the first rotating shaft 112*c* while being agitated. Further, since the toner supply opening 115*a* is provided in a position corresponding to an upper surface of the substantially central part of the compartment P having the first conveying member 112 installed therein, the toner supplied through the toner supply opening 115*a* is conveyed from the central part of the first conveying member 112 toward each end of the first conveying member 112 while being agitated.

The second conveying member 113 is constituted by a screw auger including a third conveying blade 113*a* formed in such a spiral manner as to extend from the central part of the second conveying member 113 to one end of the second conveying member 113, a fourth conveying blade 113*b* formed in such a way as to extend from the central part of the second conveying member 113 to the other end of the second conveying member 113, and a second rotating shaft 113*c* that rotates integrally with the third and fourth conveying blades 113*a* and 113*b*. It should be noted that the second rotating shaft 113*c* is parallel to the axial direction of the developing roller 114. Since the third and fourth conveying blades 113*a* and 113*b* have their blades wound in opposite directions, the rotation of the second rotating shaft 113*c* is controlled by a second conveying member driving motor 133, connected to one end of the second rotating shaft 113*c*, so that the two-component developer can be conveyed toward the central part of the second rotating shaft 113*c* from each end of the second rotating shaft 113*c* while being agitated.

In the present embodiment, the first and third conveying blades 112*a* and 113*a* are wound in the same shape, and the second and fourth conveying blades 112*b* and 113*b* are wound in the same shape. The toner can be conveyed in predetermined directions by controlling the directions of rotation of the first and second rotating shafts 112*c* and 113*c* through the first and second conveying member driving motors 132 and 133, respectively.

Of course, even if the first and third conveying blades 112*a* and 113*a* are wound in opposite directions and the second and fourth conveying blades 112*b* and 113*b* are wound in opposite directions, the same effect as above can be obtained by controlling the directions of rotation of the first and second rotating shafts 112*c* and 113*c*.

For easier comprehension of the description, it is assumed, in FIG. 3, that the developing tank 111 has: a developing tank wall 111*a* so provided substantially in parallel with the axial direction of the first rotating shaft 112*c* as to serve as a wall of the compartment P having the first conveying member 112 disposed therein; and a developing tank wall 111*b* so provided substantially in parallel with the axial direction of the second rotating shaft 113*c* as to serve as a wall of the compartment Q having the second conveying member 113 disposed therein, i.e., as to face the developing tank wall 111*a*. Further, it is assumed, in FIG. 3, that the developing tank 111 has: a developing tank wall 111*c* provided near the first and second conveying member driving motors 132 and 133, i.e., provided substantially perpendicularly to the axial directions of the first and second rotating shafts 112*c* and 113*c*; and a developing tank wall 111*d* provided on the side opposite to the developing tank wall 111*c* in such a way as to face the developing tank wall 111*c*.

As shown in FIGS. 2 and 3, the partition plate 117 (117*a*, 117*b*) is provided between the first and second conveying members 112 and 113 in parallel with the shaft of each of them (i.e., in parallel with the first and second rotating shafts 112*c* and 113*c*). Moreover, as shown in FIG. 3, the partition plate 117 has a third communicating path c, provided in the central part of each conveying member 112 or 113 along the axial direction, through which the compartments P and Q are communicated with each other. It is assumed here that the partition plate 117 is divided into a first partition section 117*a* that is closer to the developing tank wall 111*d* than is the third communicating path c and a second partition section 117*b* that is closer to the developing tank wall 111*c* than is the third communicating path c. It should be noted that the first and second conveying members 112 and 113 are arranged in a line so that their peripheral surfaces face each other across the first and second partition sections 117*a* and 117*b* provided therebetween and so that their shafts are parallel to each other.

As shown in FIG. 3, the first and second partition sections 117*a* and 117*b* are disposed at predetermined distances from the developing tank walls 111*d* and 111*c*, respectively. Therefore, the developing tank 111 has: a first communicating path a provided therein toward the developing tank wall 111*d* as a space between the developing tank wall 111*d* and the first partition section 117*a*; and a second communicating path b provided therein toward the developing tank wall 111*c* as a space between the developing tank wall 111*c* and the second partition section 117*b*.

It should be noted here that the toner supply opening 115*a* exists in a higher position than that part of the compartment P which faces the third communicating path c.

Further, during the conveyance of the two-component developer in the developing tank 111, the two-component developer is conveyed by the first conveying member 112 from the substantially central part of the first rotating shaft 112*c* (below the toner supply opening 115*a*) to the first and second communicating paths a and b provided at both ends. It is assumed here that the compartment P has: a first conveying path P1, provided between the first partition section 117*a* and the developing tank wall 111*a*, which extends from the substantially central part of the first rotating shaft 112*c* to the first communicating path a; and a second conveying path P2, provided between the second partition section 117*b* and the developing tank wall 111*a*, which extends from the substantially central part of the first rotating shaft 112*c* to the second communicating path b.

Next, the two-component developer, which has been conveyed up to the first and second communicating paths a and b, is conveyed through the first and second communicating paths a and b to the compartment Q having the second conveying member 113 installed therein, and then conveyed by the second conveying member 113 from each end of the second rotating shaft 113*c* toward the substantially central part (where the third communicating path c is). It is assumed here that the compartment Q has: a third conveying path Q1, provided between the first partition section 117*a* and the developing tank wall 111*b*, which extends from the first communicating path a to the third communicating path c; and a fourth conveying path Q2, provided between the second partition section 117*b* and the developing tank wall 111*b*, which extends from the second communicating path b to the third communicating path c.

The route of conveyance of the two-component developer in the developing tank 111 is fully described below.

That is, the toner received through the toner supply opening 115*a* is mixed and agitated into the carrier inside of the developing tank 111 by the first conveying member 112 near the central part of the compartment P to give the two-component developer. The two-component developer is divided into two portions, one of which reaches the first communicating path a via the first conveying path P1, and the other of which reaches the second communicating path b via the second conveying path P2. The two-component developer, which has reached the first and second communicating paths a and b, is conveyed to the third and fourth conveying paths Q1 and Q2 through the first and second communicating paths a and b, and then reaches the third communicating path c while being agitated by the second conveying member 113. Moreover, the two-component developer, which has reached the third communicating path c, is conveyed back to the first and second conveying paths P1 and P2 through the third communicating path c.

Therefore, in the developing tank 111, the two-component developer is conveyed separately on (i) a first route of circulation on which the two-component developer moves circularly from the first conveying path P1 through the first communicating path a, the third conveying path Q1, and the third communicating path c back again to the first conveying path P1 in the order named and (ii) a second route of circulation on which the two-component developer moves circularly from the second conveying path P2 through the second communicating path b, the fourth conveying path Q2, and the third communicating path c back again to the second conveying path P2 in the order named.

That is, the first and second conveying members 112 and 113 convey the two-component developer in opposite directions while agitating it.

Further, the developing roller 114 is a magnet roller, disposed in the developing tank 111, which is driven by driving means (not shown) to rotate on the center of axle, and is used for conveying the two-component developer from inside of the compartment Q of the developing tank 111 to the photoreceptor drum 3. Further, the developing roller 114 is provided in such a way as to face the photoreceptor drum 3 at a distance from the photoreceptor drum 3. The two-component developer is conveyed to a position of the closest proximity to the photoreceptor drum 3 by the developing roller 114 and brought into contact with the photoreceptor drum 3 in that position, whereby the electrostatic latent image formed on the surface of the photoreceptor drum 3 is developed (visualized). The region of contact between the developing roller 114 and the photoreceptor drum 3 is a developing nip area. In the developing nip area, the developing roller 114 is supplied with a developing bias voltage from a power supply (not shown) connected to the developing roller 114, whereby the toner is supplied from the two-component developer on the surface of the developing roller 114 to the electrostatic latent image on the surface of the photoreceptor drum 3.

Moreover, while being conveyed on the third and fourth conveying paths Q1 and Q2, the two-component developer is carried onto the surface of the developing roller 114 by the rotation of the developing roller 114 in a such a way as to be scooped up, and the toner contained in the two-component developer thus scooped up moves to the photoreceptor drum 3, whereby the toner is gradually consumed.

In order to make up for the toner thus consumed, unused toner is supplied to the first and second conveying paths P1 and P2 through the toner supply opening 115*a*. The toner thus supplied is mixed and agitated into the existing two-component developer near the central parts of the first and second conveying paths P1 and P2.

The doctor blade 116 is a plate member axially extending in parallel with the developing roller 114. The doctor blade 116 is provided vertically below the developing roller 114 in such a way that one end of the doctor blade 116 along a transverse direction is supported by the developing tank 111 and the other end is placed at a distance from the surface of the developing roller 114. The doctor blade 116 can be made, for example, of stainless steel, but can also be made of aluminum or synthetic resin.

The following describes the toner density detecting sensors 118 according to the present embodiment.

As shown in FIG. 3, the developing device 2 according to the present embodiment includes a first toner density detecting sensor 118*a* and a second toner density detecting sensor 118*b*. The first toner density detecting sensor 118*a*, mounted on the bottom surface of the developing tank 111 vertically below the second conveying member 113 in such a way as to be between the first communicating path a and the third communicating path c, is provided so that its sensing surface directly faces the interior of the developing tank 111. The second toner density detecting sensor 118*b*, mounted on the bottom surface of the developing tank 111 vertically below the second conveying member 113 in such a way as to be between the second communicating path b and the third communicating path c, is provided so that its sensing surface directly faces the interior of the developing tank 111.

In the present embodiment, the first toner density detecting sensor 118*a* is mounted on the bottom surface of the developing tank 111 vertically below the second conveying member 113 in such a way as to be at the end of the first route of circulation starting from the first conveying path P1, i.e., in a position on the third conveying path Q1 near the third communicating path c. Meanwhile, the second toner density detecting sensor 118*b* is mounted on the bottom surface of the developing tank 111 vertically below the second conveying member 113 in such a way as to be at the end of the second route of circulation starting from the second conveying path P2, i.e., in a position on the fourth conveying path Q2 near the third communicating path c.

It is at the end of each route of circulatory conveyance that the toner density of the two-component developer hits the lowest point. For this reason, the disposition of a toner density detecting sensor in such a position makes it possible to immediately detect a decrease in toner density in each route of circulation.

The first and second toner density detecting sensors 118*a* and 118*b* alternately transmit measured values of detected toner density to the toner supply control section 120 at predetermined time intervals (e.g., 0.5 to 1 second).

It should be noted that the first and second toner density detecting sensors 118*a* and 118*b* can be realized by ordinary toner density detecting sensors, examples of which include transmitted light detecting sensors, reflected light detecting sensors, and magnetic permeability detecting sensors. Among these, magnetic permeability detecting sensors are preferred.

Connected to the magnetic permeability detecting sensors is a power supply (not shown) which applies driving voltages to the magnetic permeability detecting sensors so that the magnetic permeability detecting sensors are driven and which applies control voltages to the magnetic permeability detecting sensors so that the magnetic permeability detecting sensors output results of toner density detection to the control means. The application of the voltages to the magnetic permeability detecting sensors by the power supply is controlled by the control means. The magnetic permeability detecting sensors are such types of sensor that output the results of toner density detection as output voltage values in response to the application of the control voltages, and as such, are basically high in sensitivity near the median value of output voltage. Therefore, the magnetic permeability detecting sensors are used by applying such control voltages that output voltages are obtained in close proximity thereto. Such types of magnetic permeability detecting sensor are commercially available, examples of which include those marketed as TS-L, TS-A, and TS-K by TDK Corporation.

The toner supply control section 120, electrically connected to the first and second toner density detecting sensors 118*a* and 118*b*, controls the supply of toner from the toner supply device 22 in accordance with the toner densities sent from these sensors, and also controls whether the toner is supplied to the first or second route of circulation. That is, the toner supply control section 120 obtains measured values of detected toner density alternately from the first and second toner density detecting sensors 118*a* and 118*b* at predetermined time intervals (e.g., 0.5 to 1 second). Then, the toner supply control section 120 makes a comparison between the measured values of detected toner density thus obtained and a preset value (threshold value) of toner density. In cases where the measured values of toner density are lower than the preset value of toner density, the toner supply control section 120 supplies from the toner supply device 22 into the developing tank 111 and controls the amount of toner that is supplied and, at the same time, adjusts the direction of toner supply by controlling a toner supply direction switching mechanism (the details of which are described later).

The supply of toner from the toner supply device 22 is carried out by sending a start-to-drive signal from the toner supply control section 120 to the toner discharge member driving motor 134 and driving the toner discharge member driving motor 134.

(Control of the Direction of Toner Supply)

Control of the direction of supply of toner from the toner supply device 22 to the developing tank 111 through the toner transport mechanism (toner transport tube) 102 is fully described below with reference to FIGS. 1, 4, and 5.

Figure 1:
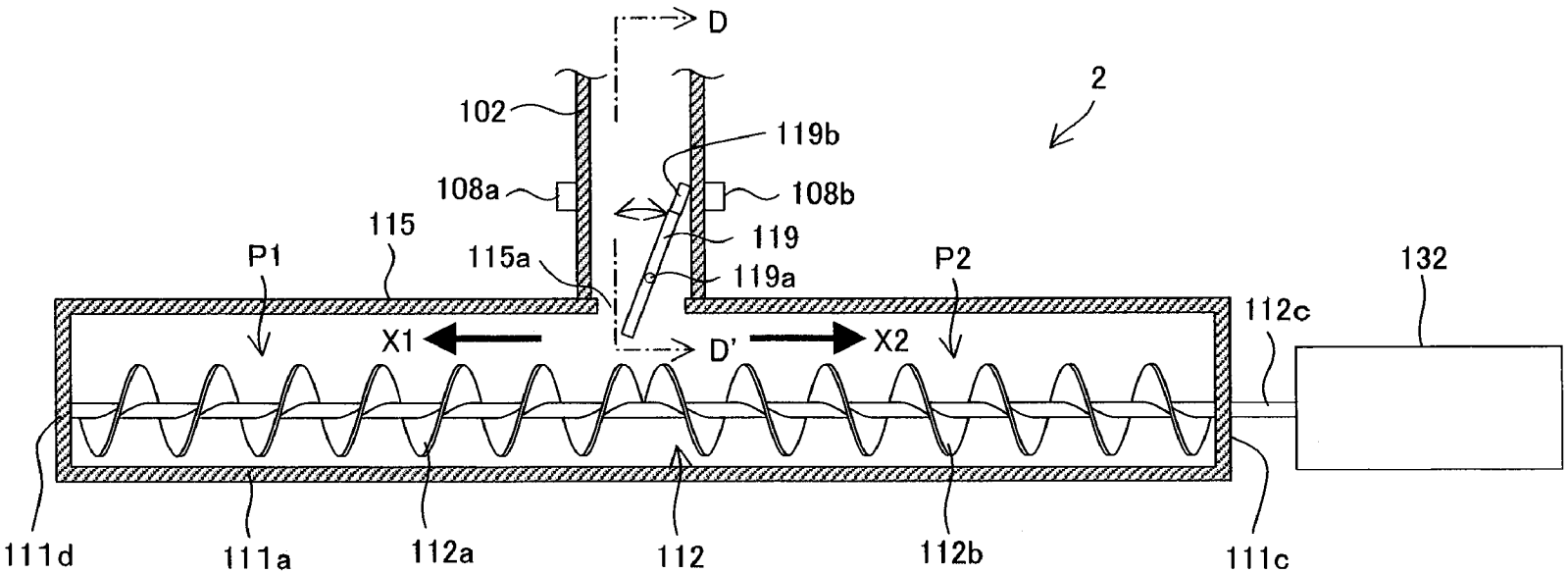
FIG. 1 is a cross-sectional view showing how a developing device according to an embodiment of the present invention and a toner supply direction switching mechanism are positioned in relation to each other.

FIG. 1 is a cross-sectional view taken along arrows B-B' in FIG. 2. FIG. 4 is a cross-sectional view taken along arrows D-D' in FIG. 1. FIG. 5 is an exploded version of FIG. 4.

The present embodiment supplies toner from the toner supply device 22 into a route of circulation in the developing tank 111 where a large amount of toner has been consumed and the value of toner density as measured by the toner density detecting sensor 118 has been judged to be lower than the preset value of toner density. For this purpose, the present embodiment employs a toner supply direction switching mechanism capable of switching the direction of toner supply so that toner can be supplied into either of the routes.

The toner supply direction switching mechanism in the present embodiment controls, in accordance with the measured values of toner density detected by the first and second toner density detecting sensors 118*a* and 118*b*, whether the toner is supplied to the first or second route of circulation.

In the present embodiment, as shown in FIG. 1, the toner supply direction switching mechanism, installed in the center of the toner supply opening 115*a*, can rotate on a rotation axis 119*a* perpendicular to the directions of conveyance (see X1 and X2 in FIG. 1) of the two-component developer in the compartment P, and includes a guide plate 119 parallel to the rotation axis 119*a* and first and second electromagnets 108*a* and 108*b* provided on opposite outer sides of the toner transport mechanism 102. The rotation axis of 119*a* of the guide plate 119 is parallel to a horizontal direction.

Figure 4:
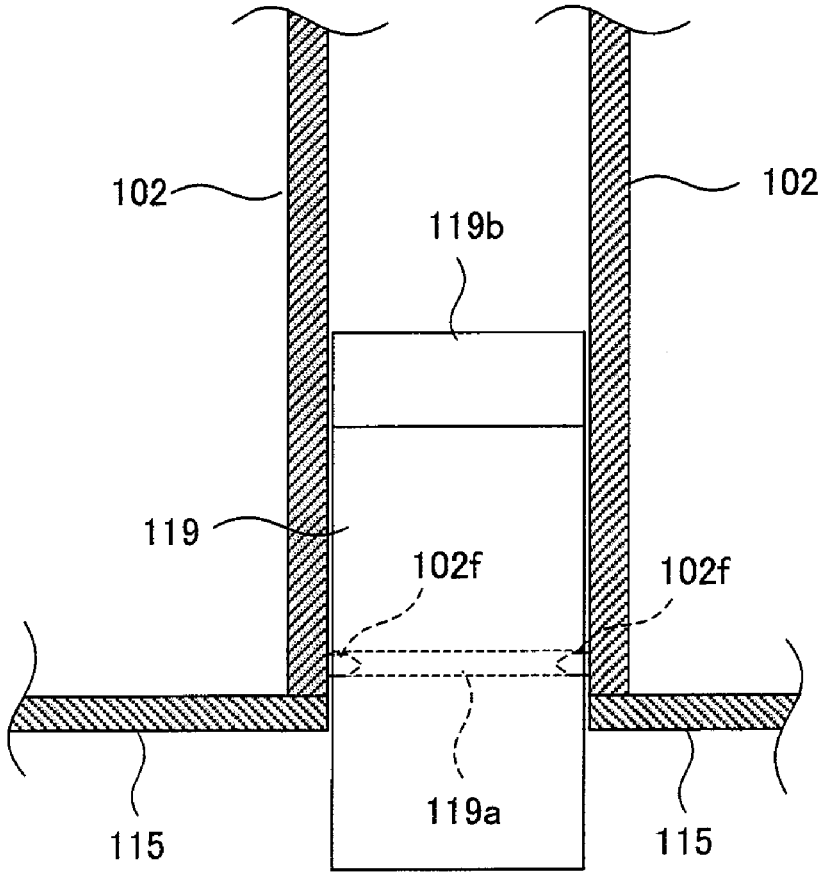
FIG. 4 is a cross-sectional view taken along arrows D-D' in FIG. 1.
Figure 5:
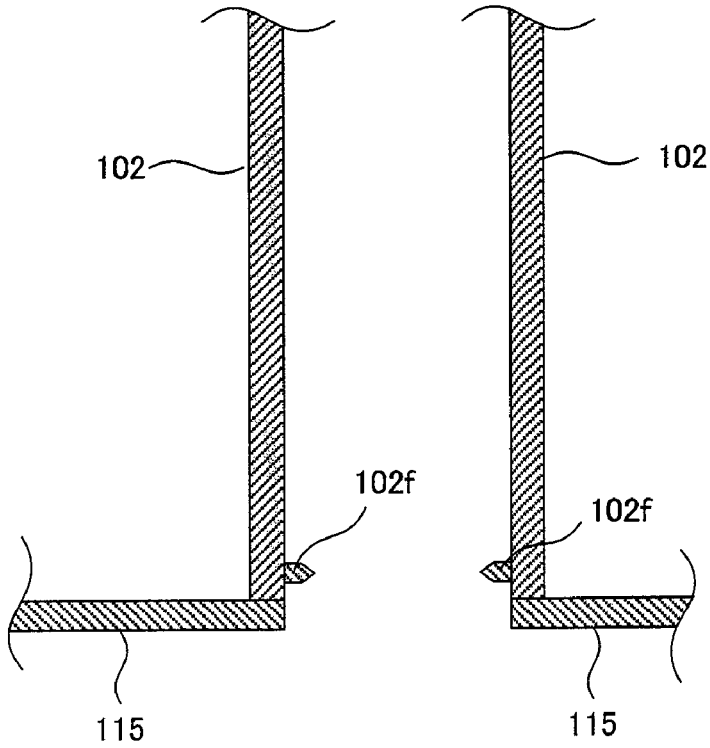
FIG. 5 is an exploded view of a guide plate and a toner transport mechanism that are shown in FIG. 4.
Figure 5:
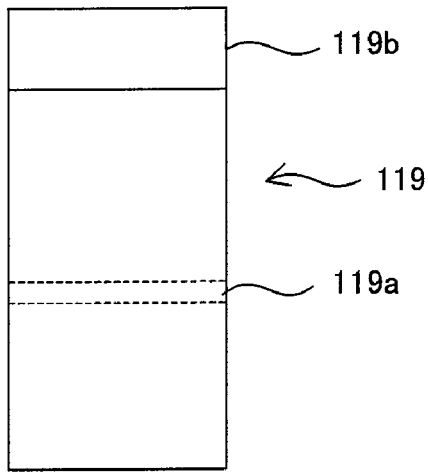

FIG. 4 shows the guide plate 119 mounted in the toner transport mechanism 102, and FIG. 5 shows the guide plate 119 separated from the toner transport mechanism 102.

As shown in FIG. 5, the toner transport mechanism has a pair of protrusions 102*f*, provided on opposite inner lower walls of the toner transport mechanism 102 near the toner supply opening 115*a*, which stick out from the inner walls toward the inner part of the toner transport mechanism 102. The guide plate 119 has depressions, provided at both ends of a portion supposed to serve as the rotation axis 119*a*, with which the pair of protrusions 102*f* can engage. That is, the depressions are provided so that the fitting of the protrusions 102*f* in the depressions allows the guide plate 119 to rotate with the protrusions 102*f* serving as points of support. In the present embodiment, the depressions are provided within the thickness of the rotation axis 119*a* in such a way as to pass through the portion supposed to serve as the rotation axis 119*a*. After the guide plate 119 has been mounted in the toner transport mechanism 102, the resulting structure looks as shown in FIG. 4.

Further, the guide plate 119 has an upper end (magnetic member) 119*b*, made of a magnetic material such as ferrite or stainless steel, which can make contact with those places on the inner walls of the toner transport mechanism 102 which correspond to the places where the first and second electromagnets 108*a* and 108*b* are. By passing an electrical current through either of the first and second electromagnets 108*a* and 108*b*, a magnetic force of attraction is generated by which the orientation of inclination of the guide plate 119 can be changed (displaced) to such an extent that the end 119*b* makes contact with either of those places on the inner walls of the toner transport mechanism 102 which correspond to the places where the first and second electromagnets 108*a* and 108*b* are.

Further, the shape of the guide plate 119 is set in accordance with the internal shape of the toner transport mechanism 102, and the length of the guide plate 119 is set so that in cases where the orientation of inclination of the guide plate 119 is displaced to such an extent that the end 119*b* makes contact with either of those places on the inner walls of the toner transport mechanism 102 which correspond to the places where the first and second electromagnets 108*a* and 108*b* are, a space through which toner can be supplied is formed between a lower end of the guide plate 119 opposite the end 119*b* and an edge of the toner supply opening 115*a* and the lower end is located toward the first or second conveying path P1 or P2 with respect to the central part of the first conveying member 112.

For this reason, for example, in cases where a magnetic force of attraction generated by passing an electrical current through the second electromagnet 108*b* attracts the end 119*b* of the guide plate 119 to that place on the inner wall of the toner transport mechanism 102 which corresponds to the place where the second electromagnet 108*b* is, the parts of the guide plate 119 other than the end 119*b* are at certain distances from the inner walls of the toner transport mechanism 102 and the end of the guide plate 119 opposite the end 119*b* is located toward the first conveying path P1 with respect to the central part of the first conveying member 112; therefore, the toner supplied from the toner supply device can be guided into the first conveying path P1. Similarly, passage of an electrical current through the first electromagnet 108*a* allows the toner supplied from the toner supply device 22 to be guided into the second conveying path P2.

Further, the guide plate 119 contains an antistatic agent in the parts other than the end 119*b* made of a magnetic material. Examples of the antistatic agent for the toner include carbon black. In cases where the antistatic agent is realized by carbon black, the guide plate 119 only needs to contain, e.g., 5 to 10% by weight of carbon black in the parts other than the end 119*b*.

The following describes how each component of the image forming apparatus according to the present embodiment works for the purpose of controlling the direction of toner supply.

The toner supply control section 120 obtains measured values of detected toner density alternately from the first and second toner density detecting sensors 118*a* and 118*b* at predetermined time intervals (e.g., 0.5 to 1 second). That is, the toner supply control section 120 obtains a measured value of toner density from the first toner density detecting sensors 118*a* and then, after a predetermined period of time has elapsed since that point of time, obtains a measured value of toner density from the second toner density detecting sensors 118*b*. Furthermore, after a predetermined period of time has elapsed since the point of time where the toner supply control section 120 obtained the measured value of toner density from the second toner density detecting sensors 118*b*, the toner supply control section 120 obtains a measured value of toner density from the first toner density detecting sensors 118*a*. The toner supply control section 120 repeats such a process.

Moreover, when the value of toner density as measured by the first toner density detecting sensor 118*a* is judged to be lower than the preset value of toner density, the toner supply control section 120 sends a start-to-drive signal to the toner discharge member driving motor 134 so that the toner discharge member 122 is driven to rotate. At the same time, the toner supply control section 120 carries out control so that an electrical current flows through the second electromagnet 108*b*.

The toner discharge member 122 is rotated, whereby the toner is discharged through the toner discharge opening 123, falls through the inner part of the toner transport mechanism 102, and reaches the guide plate 119. At this point, because of the electrical current flowing through the second electromagnet 108*b* due to the control carried out by the toner supply control section 120, the upper end 119*b* of the guide plate 119 is attracted to the second electromagnet 108*b*. Since the second electromagnet 108*b* is disposed toward the second communicating path b, the guide plate 119 is inclined at a first position of inclination where the upper end 119*b* is located toward the second communicating path b with respect to the rotation axis 119*a* and the lower end is located toward the first communicating path a with respect to the rotation axis 119*a*.

This causes the toner falling through the inner part of the toner transport mechanism 102 to reach an inclined plane of the guide plate 119, and the inclined plane causes the toner to be guided toward the first communicating path a with respect to the rotation axis 119*a*. Moreover, since the rotation axis 119*a* is located in substantially the center of the toner supply opening 115*a*, the first route of circulation extends toward the first communicating path a with respect to the rotation axis 119*a*. Therefore, the toner having slid down the inclined plane of the guide plate 119 can be guided into the first conveying path P1, which constitutes the first route of circulation.

On the other hand, when the value of toner density as measured by the second toner density detecting sensor 118*b* is judged to be lower than the preset value of toner density, the toner supply control section 120 drives the toner discharge member 122 to rotate, and also carries out control so that an electrical current flows through the first electromagnet 108*a*.

This causes the upper end 119*b* of the guide plate 119 to be attracted to the first electromagnet 108*a*. Since the first electromagnet 108*a* is disposed toward the first communicating path a, the guide plate 119 is inclined at a second position of inclination where the upper end 119*b* is located toward the first communicating path a with respect to the rotation axis 119*a* and the lower end is located toward the second communicating path b with respect to the rotation axis 119*a*.

This causes the toner falling through the inner part of the toner transport mechanism 102 to reach an inclined plane of the guide plate 119, and the inclined plane causes the toner to be guided toward the second communicating path b with respect to the rotation axis 119*a*, i.e., into the second conveying path P2, which constitutes the second route of circulation.

Since the toner discharge member 122 is constituted by a screw auger, a large amount of toner can be discharged in a short period of time; therefore, the amount of toner that needs to be supplied can be discharged in a shorter period of time than the predetermined period of time. For this reason, the supply of toner can be completed within a period of time between the point of time where the toner supply control section 120 obtains a measured value of toner density from the first toner density detecting sensor 118*a* and the point of time where the toner supply control section 120 next obtains a measured value of toner density from the second toner density detecting sensor 118*b*. That is, before obtaining the next measured value of toner density, the toner supply control section 120 sends a stop-driving signal to the toner discharge member driving motor 134 so that the toner discharge member 122 stops being driven to rotate, and also stops the flow of electricity through the first electromagnet 108*a* or the second electromagnet 108*b*.

In the present embodiment, the orientation of inclination of the guide plate 119 is displaced by producing the end 119*b* of the guide plate 119 from a magnetic material and switching between passing an electrical current through one of the two electromagnets and passing an electrical current through the other. Alternatively, it may be that the guide plate 119 has a permanent magnet and only one electromagnet is disposed on an outer side of the toner transport mechanism 102. In this case, the permanent magnet is attached to the guide plate so that, when the guide plate is inclined in such a way that the upper end approaches the electromagnet, one of the poles of the permanent magnet is located toward the electromagnet and the other is located away from the electromagnet. In this case, the permanent magnet is attracted or repulsed by switching between passing an electrical current through the electromagnet in one direction and passing an electrical current through the electromagnet in the other direction, whereby the orientation of inclination of the guide plate 119 can be changed.

For example, in the present embodiment, the orientation of inclination of the guide plate 119 can be changed simply by switching between passing an electrical current through one electromagnet in one direction and passing an electrical current through the electromagnet in the other direction, provided that the end 119*b* of the guide plate 119 is constituted by a permanent magnet and it is determined which of the (north and south) poles of the permanent magnet faces toward the electromagnet.

Further, in the present embodiment, the depressions of the guide plate 119 are provided within the thickness of the rotation axis 119*a* in such a way as to pass through the portion supposed to serve as the rotation axis 119*a*. Alternatively, depending on the length of each protrusion 102*f*, both ends of the portion supposed to serve as the rotation axis 119*a* may be depressed as deep as the protrusions 102*f* can be fitted in the depressions with play.

As described above, an image forming apparatus of the present invention is an image forming apparatus including: an image bearing member; a developing device including (a) a developing roller, (b) a developing container having first and second compartments in which a two-component developer containing the toner is stored, the first and second compartments being two compartments divided from each other by a partition member extending along an axial direction of the developing roller, and (c) a conveying member, installed in the first and second compartments, which agitates and conveys the two-component developer, the developing device supplying the image bearing member with toner contained in a two-component developer stored in the second compartment; and a toner supply device that supplies the developing device with toner, the first and second compartments being communicated with each other through a first communicating path at one end of the axial direction and through a second communicating path at the other end of the axial direction, the partition member having a third communicating path, provided between the first and second communicating path, through which the first and second compartments are communicated with each other, the conveying member conveying the two-component developer on (i) a first route of circulation leading from the third communicating path to the first communicating path in the first compartment and further leading from the first communicating path to the third communicating path in the second compartment and (ii) a second route of circulation leading from the third communicating path to the second communicating path in the first compartment and further leading from the second communicating path to the third communicating path in the second compartment, the developing container having one toner supply opening, provided in that position on an upper surface of the first compartment which faces the third communicating path along the axial direction, which is used for receiving the toner that is supplied from the toner supply device, a first toner density detecting sensor provided between the first communicating path and the third communicating path in the second compartment, and a second toner density detecting sensor provided between the second communicating path and the third communicating path in the second compartment, and including a toner supply switching section that chooses, in accordance with toner densities detected by the first and second toner density detecting sensors, whether the toner that is supplied from the toner supply device is guided into the first or second route of circulation.

According to the foregoing configuration, the two-component developer is circularly conveyed in the developing device on the first route of circulation from the third communicating path toward the first communicating path along the axial direction of the developing roller, and is conveyed circularly on the second route of circulation from the third communicating route toward the second communicating path along the axial direction of the developing roller. Therefore, in the case of printing of such an image that a large amount of toner is consumed in a position corresponding to a side closer to the first communicating path than to the third communicating path, the toner contained in the two-component developer being conveyed on the first route of circulation is consumed. On the other hand, in the case of printing of such an image that a large amount of toner is consumed in a position corresponding to a side closer to the second communicating path than to the third communicating path, the toner contained in the two-component developer being conveyed on the second route of circulation is consumed.

However, according to the foregoing configuration, the toner supply switching section makes it possible to supply the toner from the toner supply device selectively into the first or second route of circulation in accordance with toner densities detected by the first and second toner density detecting sensors respectively provided on the first and second routes of circulation. Therefore, for example, in cases where such a large amount of toner is consumed in the first route of circulation that the first toner density detecting sensor detects a low toner density, the toner from the toner supply device can be supplied to the first route of circulation. In this way, even in the case of such an image that a large amount of toner is consumed at either end of the developing roller, nonuniformity in toner density of the two-component developer can be suppressed without extremely complexifying a toner supply mechanism. Furthermore, the provision of the two routes of circulation makes it possible for the toner to be supplied to the developing roller at a short distance, whereby a time lag in toner density control can be shortened.

Further, the image forming apparatus according to the present invention is preferably configured such that: the toner supply device is located above the toner supply opening of the developing container; and the toner supply switching section includes (i) a guide plate, installed in a center of the toner supply opening, which is able to rotate on an axis of rotation perpendicular to a direction of conveyance of the two-component developer in the first compartment and which is parallel to the axis of rotation and (ii) a guide plate displacement member that causes the guide plate to be inclined at either a first position of inclination where an upper end of the guide plate is located toward the second communicating path and a lower end of the guide plate is located toward the first communicating path, or a second position of inclination where the upper end is located toward the first communicating path and the lower end is located toward the second communicating path.

According to the foregoing configuration, the toner falls gravitationally from the toner supply device located above the toner supply opening, whereby the toner is supplied to the toner supply opening. Moreover, the guide plate has a rotation axis parallel to the plate, and the rotation axis is perpendicular to the axial direction of the developing roller. Therefore, the guide plate can rotate to take such a position as to be inclined with respect to the axial direction of the developing roller. Further, the guide plate displacement member can switch the guide plate between the first position of inclination and the second position of inclination. At the first position of inclination, the upper end of the guide plate is located toward the second communicating path and the lower end of the guide plate is located toward the first communicating path. This causes the toner falling from above to reach an inclined plane of the guide plate, and the inclined plane causes the toner to be guided toward the first communicating path with respect to the rotation axis. Since the rotation axis is located in the center of the toner supply opening provided on that upper surface of the first compartment which corresponds to the third communicating path, the first route of circulation extends toward the first communicating path with respect to the rotation axis. Therefore, the toner can be guided into the first route of circulation by switching to the first position of inclination. On the other hand, the toner can be guided into the second route of circulation by switching to the second position of inclination. This makes it possible to easily switch between supplying the toner from the toner supply device to the first route of circulation and supplying the toner from the toner supply device to the second route of circulation.

Further, the image forming apparatus according to the present invention is preferably configured such that the toner supply switching section receives measured values of toner density alternately from the first and second toner density detecting sensors at predetermined time intervals, guides the toner from the toner supply device into the first route of circulation when a measured value of toner density as sent from the first toner density detecting sensor is lower than a predetermined threshold value, and guides the toner from the toner supply device into the second route of circulation when a measured value of toner density as sent from the second toner density detecting sensor is lower than the predetermined threshold value.

According to the foregoing configuration, a process of switching between the destinations of toner supply in accordance with a result of detection by the first toner density detecting sensor and a process of switching between the destinations of toner supply in accordance with a result of detection by the second toner density detecting sensor are carried out alternately at the predetermined time intervals. This makes it possible to easily realize a process of switching between the destinations of toner supply in accordance with the results of detection by the two toner density detecting sensors.

Further, the image forming apparatus according to the present invention is preferably configured such that: the guide plate has a magnetic member made of a magnetic material; and the guide plate displacement member is an electromagnet capable of generating a magnetic force that acts on the magnet member.

The guide plate may be rotated by attaching a moving part such as a motor to the rotation axis of the guide plate. In this case, the moving part is usually installed outside of the developing container. For this reason, a coupling part for connecting the moving part to the rotation axis of the guide plate needs to pass through a wall of the developing container. Since the coupling part rotates together with the rotation axis, the wall of the developing container needs to be provided with a bearing in which the coupling part is held. Such a bearing is prone to agglutination of toner.

However, the foregoing configuration can displace the orientation of inclination of the guide plate with use of a force of attraction that is generated by passing an electrical current through the electromagnet, i.e., can displace the guide plate in a noncontact manner. This eliminates the need for such a coupling part or moving part making contact with the guide plate, thus allowing a reduction in number of parts. This makes it possible to minimize the number of places where toner agglutinates.

Further, the image forming apparatus according to the present invention is preferably configured such that the magnetic member is a permanent magnet.

According to the foregoing configuration, the permanent magnet is attracted or repulsed simply by changing from passing an electrical current through the electromagnet in one direction to passing an electrical current through the electromagnet in the other direction, whereby the orientation of the guide plate can be changed with one electromagnet.

Further, the image forming apparatus according to the present invention is preferably configured such that: the conveying member includes a first conveying member disposed in the first compartment and a second conveying member disposed in the second compartment; and the first and second conveying members are each a screw auger having conveying blades, wound in opposite directions, one of which extends from the third communicating path to the first communicating path, and the other of which extends from the third communicating path to the second communicating path.

According to the foregoing configuration, the screw auger has two conveying blades wound in opposite directions, whereby the two-component developer can be conveyed in opposite directions by one screw auger. Further, because a screw auger can convey the two-component developer under low stress even at a high speed of rotation, the two-component developer is quite unlikely to wear or deteriorate.

Further, the image forming apparatus according to the present invention is preferably configured such that: the toner supply device includes (i) a toner storage container provided with a toner discharge opening and (ii) a toner discharge member, disposed in the toner storage container, which conveys the toner down to the toner discharge opening; and the toner discharge member is a screw auger.

The foregoing configuration can supply a large amount of toner in a short period of time by employing a screw auger as the toner discharge member, thus preventing a decrease in toner density.

Further, the image forming apparatus according to the present invention is preferably configured such that the guide plate contains an antistatic agent.

The foregoing configuration makes it possible to prevent the toner from adhering to the guide plate.

Further, the image forming apparatus according to the present invention is preferably configured such that the toner supply opening is provided in a central part of the first compartment along the axial direction.

According to the foregoing configuration, the first and second routes of circulation become equal in length, whereby the developing device can be configured in a simple structure.

Finally, the toner supply direction switching mechanism according to the present invention is not limited to the embodiment above, but may be altered within the scope of the claims. For example, the structure of the toner supply direction switching mechanism, the mounting location of the toner supply direction switching mechanism, or the like may be altered appropriately within such a scope that the direction of supply can be switched.

INDUSTRIAL APPLICABILITY

The present invention can be applied to a small-sized developing device because a toner supply direction switching mechanism can control the direction of toner supply even in cases where only one toner supply opening is provided.

REFERENCE SIGNS LIST

2 Developing device
3 Photoreceptor drum (image bearing member)
22 Toner supply device
102 Toner transport mechanism
**102*f*** Protrusion (toner supply switching section)
**108*a*, 108*b*** Electromagnet (toner supply switching section)
111 Developing tank (developing container)
112 First conveying member
113 Second conveying member
114 Developing roller
115 Developing tank cover (developing container)
**115*a*** Toner supply opening
117 Partition plate (partition member)
**118*a*, 118*b*** Toner density detecting sensor
119 Guide plate (toner supply switching section)
**119*a*** Rotation axis
**119*b*** End (magnetic member)
120 Toner supply control section (toner supply switching section)
121 Toner storage container
122 Toner discharge member
123 Toner discharge opening
124 Toner discharge member partition wall
125 Toner agitating member
132, 133, 134 Motor
P Compartment (first compartment)
Q Compartment (second compartment)
P1 First conveying path
P2 Second conveying path
Q1 Third conveying path
Q2 Fourth conveying path

The invention claimed is:

1. An image forming apparatus including an image bearing member, a developing device that supplies the image bearing member with toner contained in a two-component developer, and a toner supply device that supplies the developing device with toner, the developing device comprising:

a developing roller;

a developing container in which the two-component developer is stored, the developing container having a partition member that is used for dividing an internal space of the developing container into a first compartment and a second compartment and that extends along an axial direction of the developing roller; and a conveying member, installed in the first and second compartments, which agitates and conveys the two-component developer, the developing roller supplying the image bearing member with toner contained in a two-component developer stored in the second compartment, the first and second compartments being communicated with each other through a first communicating path at one end of the axial direction and through a second communicating path at the other end of the axial direction, the partition member having a third communicating path, provided between the first and second communicating path, through which the first and second compartments are communicated with each other, the developing container including an upper wall covering the first compartment, a first toner density detecting sensor provided between the first communicating path and the third communicating path in the second compartment, and a second toner density detecting sensor provided between the second communicating path and the third communicating path in the second compartment, the upper wall having one toner supply opening, provided in a higher position than a portion of the first compartment that faces the third communicating path, which is used for receiving the toner that is supplied from the toner supply device, the conveying member conveying the two-component developer on (i) a first route of circulation leading from the third communicating path to the first communicating path in the first compartment and further leading from the first communicating path to the third communicating path in the second compartment and (ii) a second route of circulation leading from the third communicating path to the second communicating path in the first compartment and further leading from the second communicating path to the third communicating path in the second compartment, the image forming apparatus including a toner supply switching section that chooses, in accordance with toner densities detected by the first and second toner density detecting sensors, whether the toner that is supplied from the toner supply device is guided into the first or second route of circulation, the toner supply device is located above the toner supply opening of the developing container, and the toner supply switching section includes (i) a guide plate, installed in a center of the toner supply opening, which is able to rotate on an axis of rotation perpendicular to a direction of conveyance of the two-component developer in the first compartment and which is parallel to the axis of rotation and (ii) a guide plate displacement member that causes the guide plate to be inclined at either a first position of inclination where an upper end of the guide plate is located toward the second communicating path and a lower end of the guide plate is located toward the first communicating path, or a second position of inclination where the upper end is located toward the first communicating path and the lower end is located toward the second communicating path.

2. The image forming apparatus as set forth in claim 1, wherein the toner supply switching section receives measured values of toner density alternately from the first and second toner density detecting sensors at predetermined time intervals, guides the toner from the toner supply device into the first route of circulation when a measured value of toner density as sent from the first toner density detecting sensor is lower than a predetermined threshold value, and guides the toner from the toner supply device into the second route of circulation when a measured value of toner density as sent from the second toner density detecting sensor is lower than the predetermined threshold value.

3. The image forming apparatus as set forth in claim 1, wherein:

the guide plate has a magnetic member made of a magnetic material; and the guide plate displacement member is an electromagnet capable of generating a magnetic force that acts on the magnet member.

4. The image forming apparatus as set forth in claim 3, wherein the magnetic member is a permanent magnet.

5. The image forming apparatus as set forth in claim 1, wherein:

the conveying member includes a first conveying member disposed in the first compartment and a second conveying member disposed in the second compartment; and the first and second conveying members are each a screw auger having conveying blades, wound in opposite directions, one of which extends from the third communicating path to the first communicating path, and the other of which extends from the third communicating path to the second communicating path.

6. The image forming apparatus as set forth in claim 1, wherein:

the toner supply device includes (i) a toner storage container provided with a toner discharge opening and (ii) a toner discharge member, disposed in the toner storage container, which conveys the toner down to the toner discharge opening; and the toner discharge member is a screw auger.

7. The image forming apparatus as set forth in claim 1, wherein the guide plate contains an antistatic agent.

8. The image forming apparatus as set forth in claim 1, wherein the toner supply opening is provided in a central part of the first compartment along the axial direction.

* * * * *